US008129041B2

(12) United States Patent
Ghasripoor et al.

(10) Patent No.: US 8,129,041 B2
(45) Date of Patent: Mar. 6, 2012

(54) ARTICLE HAVING A PROTECTIVE COATING AND METHODS

(75) Inventors: Farshad Ghasripoor, Glenville, NY (US); Guido Felice Forte, Jr., Rensselaer, NY (US); David Ernest Welch, Amsterdam, NY (US); Yogesh Kesrinath Potdar, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1341 days.

(21) Appl. No.: 11/744,506

(22) Filed: May 4, 2007

(65) Prior Publication Data

US 2010/0140529 A1 Jun. 10, 2010

Related U.S. Application Data

(63) Continuation-in-part of application No. 11/588,146, filed on Oct. 26, 2006, now abandoned.

(51) Int. Cl.
*B32B 15/04* (2006.01)

(52) U.S. Cl. ..... 428/698; 428/697; 428/217; 428/335; 428/336; 257/368

(58) Field of Classification Search ..... None
See application file for complete search history.

(56) References Cited

U.S. PATENT DOCUMENTS

2006/0018760 A1* 1/2006 Bruce et al. ..... 416/229 A
2007/0065679 A1* 3/2007 Strangman ..... 428/698

* cited by examiner

*Primary Examiner* — Aaron Austin
(74) *Attorney, Agent, or Firm* — Sutherland, Asbill & Brennan LLP

(57) ABSTRACT

An article comprising an article having a first surface and a second surface adapted to come into contact with the first surface and a first protective coating on at least a portion of the first surface. The first protective coating comprises a first coating layer. The first coating layer comprises a first component comprising boron, titanium or chromium and a second component comprising nitrogen or carbon. At least a portion of the first protective coating comes into contact with the second surface when the second surface comes into contact with the first surface. A method for reducing the wear and galling of a first surface of an article comprising applying a coating to the first surface of the article.

17 Claims, 1 Drawing Sheet

ARTICLE HAVING A PROTECTIVE COATING AND METHODS

CROSS-REFERENCE TO RELATED APPLICATION

This application is a continuation in part of U.S. patent application Ser. No. 11/588,146, filed Oct. 26, 2006, which is hereby incorporated by reference in its entirety.

TECHNICAL FIELD

This invention relates to wear and galling resistant article and more particularly relates to a protective coating for such an article.

BACKGROUND OF THE INVENTION

In applications where apparatuses and mechanical components are subjected to extreme conditions such as high steam pressure and high thermal stresses, wear and galling of the article can adversely affect the reliability and life of the apparatus components. Steam turbine valves are just one example of a component which has an increased likelihood of galling or significant wear on its sliding and contact surfaces due to extreme steam turbine operating conditions. Valve components have frequent opening and closing cycles, high impact loads, and significant steam pressure during cold, warm or hot start of a steam turbine. These repeated stresses exacerbate the wear and galling of steam turbine valves. The susceptible surfaces include, but are not limited to, valve disks, valve seats, valve stems, valve bushings, valve disks, and balance chambers.

The results of galling and wear of steam turbine valves can include leaks, the inability to open the valve causing failure to produce and deliver power to a grid, an inability to isolate the steam path, and a severely compromised seal of the steam path in the valve which could cause a turbine overspeed event during emergency shutdown conditions. Other examples of articles which may be susceptible to wear and galling include, but are not limited to, airfoil buckets, nozzles, and turbines.

Previously, nitrides or thermally sprayed carbides have been applied to articles to prevent wear and galling. However, nitrided surface/layer coatings can only be applied to certain classes of materials and nickel-based alloys cannot be gas, plasma or bath nitrided by traditional means. In addition, these nitride coatings provide a hardness of about 1,000 Vickers, which does not result in adequate wear and galling resistance. Furthermore, forming nitrides with unsuitable (i.e., un-nitridable) alloys can severely reduce the corrosion resistance of some of the alloys. Nitriding can also be reversible above about 1100° F., resulting in loss of surface hardness. Accordingly, there is a need for a simple and economically desirable wear and galling resistant article for use in various conditions such as high pressure and high thermal stress conditions.

SUMMARY OF THE INVENTION

This disclosure provides an article having a first surface and a second surface adapted to come into contact with the first surface and a first protective coating on at least a portion of the first surface. The first protective coating comprises a first coating layer having a first component and a second component. The first component comprises boron, titanium, or chromium and the second component comprises nitrogen or carbon. At least a portion of the first protective coating comes into contact with the second surface when the second surface comes into contact with the first surface.

In addition, this disclosure also encompasses a method for reducing the wear and galling of a first surface of an article. The method comprises applying a coating to the first surface of the article. The coating comprises a first component comprising boron, titanium, or chromium and a second component comprising nitrogen or carbon. The article further comprises a second surface adapted to come into contact with at least a portion of the coating on the first surface of the article.

Furthermore, this disclosure discloses a method for applying a protective coating to a valve to reduce the wear and galling of at least a portion of the valve. The method comprises depositing, onto at least a portion of the valve, a first coating having a first component comprising boron, titanium, or chromium and a second component comprising nitrogen or carbon.

Other objects, features, and advantages of this invention will be apparent from the following detailed description, drawing, and claims.

DETAILED DESCRIPTION OF EMBODIMENTS

Figure 1:
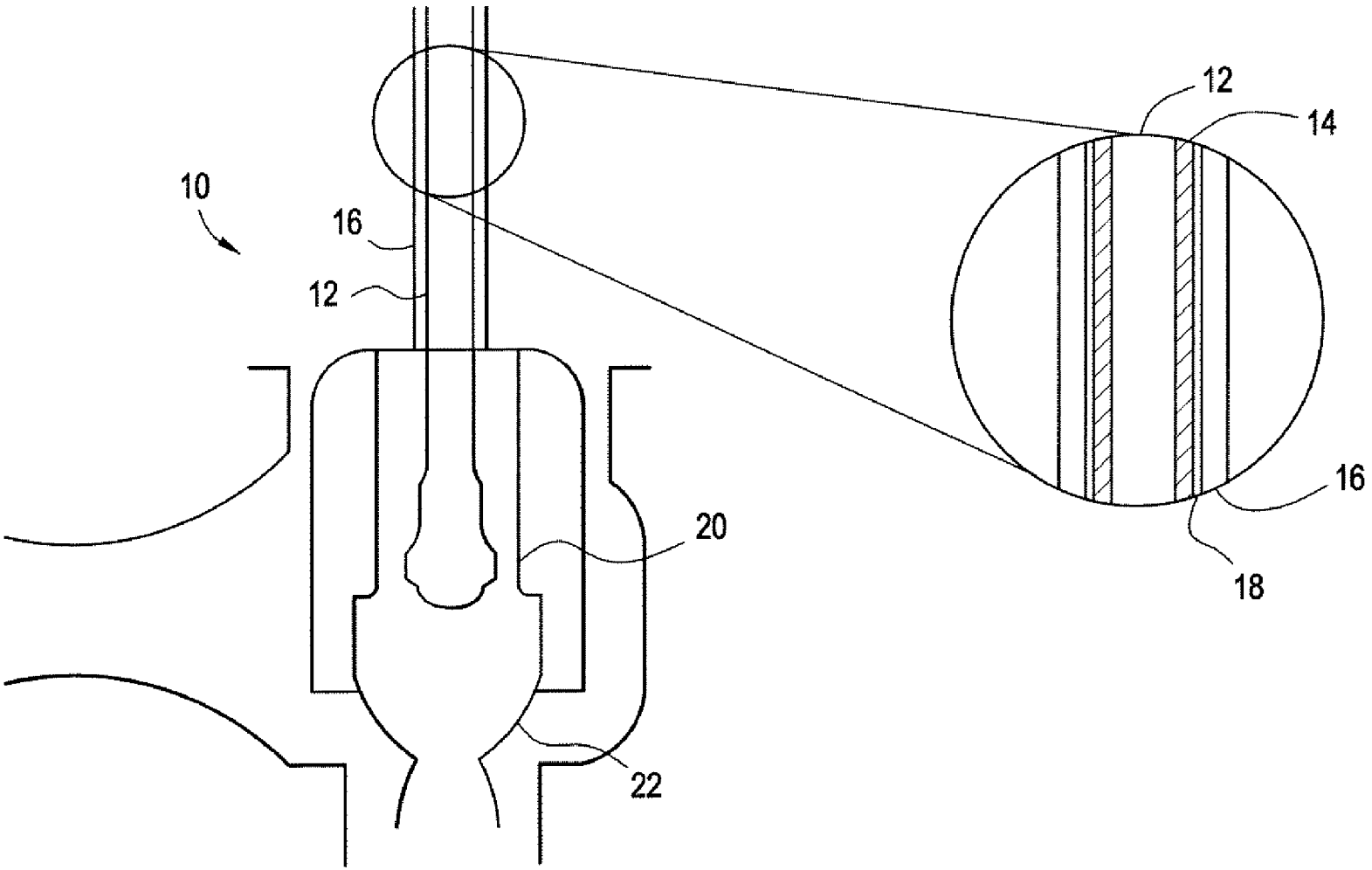
FIG. 1 is a cross-sectional side view of a steam turbine valve made in accordance with one embodiment.

As summarized above this disclosure encompasses an article, a method for reducing the wear and galling of a first surface of an article, and a method for applying a protective coating to a valve. Embodiments of the article, embodiments of the method for improving the wear and galling resistance of the article, and embodiments of the method of applying a protective coating to a valve are described below and illustrated in FIG. 1.

FIG. 1 illustrates an article 10 having a first surface 12 and comprising a first protective coating 14 on at least a portion of the first surface. In this embodiment, the article 10 comprises a steam turbine valve having a stem corresponding to the first surface 12. The article 10 further comprises a second surface 16, which is a stem bushing, having a second protective coating 18. The valve 10 additionally includes a valve disk 20 and a valve seating 22. The second surface 16 is adapted to come into contact with the first surface 12, such that the first protective coating 14 comes into contact with at least a portion of the second surface. In the embodiment illustrated, the first protective coating 14 comes into contact with the portion of the second surface 16 which has the second protective coating 18. By having the first protective coating 14 contact the second surface 16, the wear and galling of the first surface 12 is reduced.

It should be understood, however, that in other embodiments the article may comprise any article or device in need of a protective coating. For example, the article may comprise other types of valves and valve components.

The first surface 12 may comprise any material capable of withstanding the minimum process temperature of the application in which the article is to be used. For example, a steam turbine valve surface must be able to withstand temperatures of at least about 1000° F. In some embodiments, the first surface may be able to withstand temperatures between 850° F. and 1100° F. Examples of a suitable material for use as the first surface 12 in embodiments of this invention include nickel, nickel alloys, nickel based superalloys, cobalt, cobalt-nickel based alloys, steels, and combinations thereof.

The first protective coating 14 comprises a first coating layer. The first coating layer comprises a first component and a second component. Examples of suitable first components for embodiments of this invention include, but are not limited to, boron, titanium, or chromium. The second component may comprise, but is not limited to, nitrogen or carbon, for example. Thus, in embodiments where the first component comprises titanium, the first coating layer may comprise titanium nitride (which as a maximum operating temperature of about 1050° F.) or titanium carbide. In other embodiments where the first component comprises chromium, the first coating layer may comprise chromium nitride or chromium carbide. In yet other embodiments where the first component comprises boron, the first coating layer may comprises boron nitride or boron carbide.

In yet another embodiment the first coating layer may comprise a third component. Examples of suitable third components for embodiments of this invention include, but are not limited to, aluminum or carbon. Thus, in particular embodiments, the first coating layer may comprise titanium aluminum nitride.

Embodiments of the first protective coating 14 improve the wear and galling resistance of the steam turbine valve 10 by having a hardness ranging from about 1500 Vickers to about 3500 Vickers. Since the first protective coating 14 has a high hardness, it provides good abrasion resistance and erosion resistance. In addition, the first protective coating 14 generally provides good sliding wear resistance, oxidation resistance, and have low friction.

In some embodiments, the first protective coating 14 may comprise the first coating layer and a second coating layer disposed on the first coating layer. The first coating layer has a first hardness and the second coating layer has a second hardness less than the first hardness, or vice versa. In other embodiments, more than two coating layers may be provided in a protective coating, each having a different hardness. In such protective coatings, the application of more than one coating layer provides more ductile protective coatings by minimizing residual stresses in the coatings while still imparting the total coating thickness required.

The second coating layer may comprise any component which may be included in the first coating layer. For example, in particular embodiments the second coating layer may comprise titanium, chromium, or titanium aluminum nitride. In other embodiments, the second coating layer may comprise titanium nitride, titanium carbide, chromium nitride, chromium carbide, boron nitride, or boron carbide. The second coating layer minimizes stresses in the first protective coating 14 and thus, protective coatings having greater total thicknesses than protective coatings of pure metals of nitrides or carbides. For example, in particular embodiments, the first coating layer may comprise titanium aluminum nitride while the second coating layer comprises titanium, or the first coating layer may comprise chromium nitride while the second coating layer may comprise chromium.

According to particular embodiments of the invention where the first coating layer comprises a third component, the third component is present in the first coating layer in an amount ranging from about 20 atomic % of the first coating layer to about 30 atomic % of the first coating layer. In particular embodiments, wherein the first coating layer comprises titanium aluminum nitride, this amount of the third component, aluminum, provides sufficient hardness and high oxidation temperature. Thus, in one embodiment where the first coating layer comprises titanium aluminum nitride, the ratio by weight of titanium to aluminum is about 74 to 26. [In other embodiments, the hardness of the first coating layer is increased and the ratio by weight of titanium to aluminum is less than 70 to 30. In another embodiment, the top layer may comprise a hard layer with a complex structure such as TiAlN having a range of 20-30 atomic % of aluminum. At 26 atomic % aluminum, the TiAlN coating provides high hardness combined with high oxidation temperature. In addition, increasing aluminum content would improve oxidation resistance and decrease hardness.

In some embodiments, the first coating layer has a thickness of about 1 microns to about 5 microns. In embodiments wherein the protective coating 14 comprises multiple coating layers, each layer may be about 1 microns to about 5 microns thick. In some embodiments, the protective coating 14 has a total thickness of about 1 microns to about 50 microns.

Embodiments of the second surface 16 may comprise materials similar to the materials of the first surface 12 described above. The second protective coating 18 may comprise a coating layer similar to the first coating layer of the first protective coating 14 described above. In particular embodiments, the second protective coating 18 may comprise a plurality of coating layers similar to the coating layers of the first protective coating 14 described above.

The first protective coating 14 may be applied to an article such as the steam turbine valve 10 by depositing a first coating layer onto the first surface 12 of the article. The first coating layer comprises a first component and a second component. The first component may comprise boron, titanium, or chromium. The second component may comprises carbon or nitrogen. In particular embodiments, the deposition of the first coating layer can comprise cathodic arc deposition or electron beam deposition.

In embodiments wherein the protective coating comprises multiple coating layers, the coating layers may be applied successively to form the protective coating 14.

It should be apparent that the foregoing relates only to the preferred embodiments of the present application and that numerous changes and modifications may be made herein by one of ordinary skill in the art without departing from the generally spirit and scope of the invention as defined by the following claims and the equivalents thereof.

We claim:

1. An article comprising:

a first surface and a second surface operatively associated with the first surface for contacting the first surface, wherein the first surface and the second surface each comprise materials selected from the group consisting of nickel, nickel alloys, nickel based superalloys, cobalt, cobalt-nickel alloys, steels, and combinations thereof; and a first protective coating on at least a portion of the first surface, the first protective coating comprising a first coating layer and a second coating layer, the first coating layer having a hardness ranging from about 1500 Vickers to about 3500 Vickers and comprising a first component and a second component, the first component comprising boron, titanium, or chromium and the second component comprising nitrogen or carbon, and the second coating layer having a hardness ranging from about 300 Vickers to about 1500 Vickers, wherein at least a portion of the first protective coating comes into contact with the second surface when the second surface comes into contact with the first surface.

2. The article of claim 1, wherein the first coating layer comprises titanium nitride, titanium carbide, chromium nitride, chromium carbide, boron nitride, or boron carbide.

3. The article of claim 1, wherein the first coating layer further comprises a third component comprising aluminum or carbon.

4. The article of claim 1, wherein the second coating layer comprises titanium or titanium aluminum nitride.

5. The article of claim 1, wherein the first protective coating has a total thickness of about 1 microns to about 50 microns.

6. The article of claim 1, wherein the first coating layer has a thickness of about 1 to 5 microns.

7. The article of claim 1, wherein the first protective coating is a wear and galling resistant coating.

8. The article of claim 1, wherein the article is a steam turbine valve, and wherein the first surface comprises a steam turbine valve stem bushing, a steam turbine valve stem, a steam turbine valve disk, or a steam turbine valve seating.

9. The article of claim 1, wherein the second coating layer has a thickness of about 1 to 5 microns.

10. The article of claim 1, further comprising a second protective coating on at least a portion of the second surface, the second protective coating comprising a third coating layer, the third coating layer comprising a third component and a fourth component, the third component comprising boron, titanium, or chromium and the fourth component comprising nitrogen or carbon.

11. The article of claim 10, wherein the second protective coating further comprises a fourth coating layer.

12. The article of claim 11, wherein the fourth coating layer has a thickness of about 1 to 5 microns.

13. The article of claim 11, wherein the fourth coating layer has a hardness ranging from about 300 Vickers to about 1500 Vickers.

14. The article of claim 10, wherein the second protective coating has a total thickness of about 1 microns to about 50 microns.

15. The article of claim 10, wherein the second protective coating is a wear and galling resistant coating.

16. The article of claim 10, wherein the third coating layer has a thickness of about 1 to 5 microns.

17. The article of claim 10, wherein the third coating layer has a hardness ranging from about 1500 Vickers to about 3500 Vickers.

* * * * *